US005244502A

United States Patent [19]

Schaper et al.

[11] Patent Number: 5,244,502

[45] Date of Patent: Sep. 14, 1993

[54] CONTINUOUSLY OPERATING CENTRIFUGE

[75] Inventors: Helmut Schaper, Braunschweig; Heinrich Kurland, Erkerode-Lucklum, both of Fed. Rep. of Germany

[73] Assignee: Braunschweigische Maschinenbauanstalt AG, Braunschweig, Fed. Rep. of Germany

[21] Appl. No.: 800,856

[22] Filed: Nov. 26, 1991

[30] Foreign Application Priority Data

Nov. 30, 1990 [EP] European Pat. Off. ..... 90122964

[51] Int. Cl.[5] ..... C13F 1/06; B04B 1/08; B04B 7/14

[52] U.S. Cl. ..... 127/19; 127/56; 494/67; 494/68; 494/70; 494/56; 210/380.1; 210/402; 210/404

[58] Field of Search ..... 127/19, 56; 494/67, 494/68, 69, 70, 71, 72, 56; 210/380.1, 381, 402, 404

[56] References Cited

U.S. PATENT DOCUMENTS

| | | | |
|---|---|---|---|
| 3,837,913 | 9/1974 | Hillebrand et al. | 127/19 |
| 3,989,185 | 11/1976 | Mercier | 494/67 |
| 4,033,879 | 7/1977 | Natt et al. | 127/56 |
| 4,645,540 | 2/1987 | Trojan | 494/70 |
| 4,718,945 | 1/1988 | Schaper et al. | 127/19 |

*Primary Examiner*—Theodore Morris
*Assistant Examiner*—Patricia C. Hailey
*Attorney, Agent, or Firm*—W. G. Fasse

[57] ABSTRACT

A continuously operable centrifuge for spinning off sugar massecuite has an upwardly conically expanded strainer basket (20) mounted for rotation about a vertical axis (16). A downwardly conically expanding massecuite distributor (40) rotating with the basket reaches into a floor region of the strainer basket substantially coaxially to the strainer basket. The lower rim of the distributor forms a throw-off edge. Inside and in the upper region of the massecuite distributor (40), a distributing cup (30) is for distributing massecuite. The peripheral wall of the massecuite distributor (40) is formed by several ring elements (41), (42, 43) which partly overlap in the axial direction leaving an annular gap (44, 45). The product distributor is surrounded by a downwardly conically expanding stationary bell (51) which forms a further gap or gap space between itself and the rotating rings.

5 Claims, 2 Drawing Sheets

CONTINUOUSLY OPERATING CENTRIFUGE

FIELD OF INVENTION

The invention relates to a continuously operable centrifuge for spinning off sugar massecuites, with an upwardly conically expanding strainer basket which rotates about a vertical axis, a downwardly conically expanding massecuite distributor which reaches into the floor region of the strainer basket substantially coaxial to the strainer basket. The distributor forms at its bottom rim a throw-off edge and rotates about the same vertical axis as the strainer basket. The distributor includes a distribution cup positioned inside, and in the upper region of the massecuite distributor for charging massecuite into the axis region of the centrifuge.

BACKGROUND INFORMATION

Centrifuges such as this are disclosed for example by DE 22 07 663 C3 or DE 38 28 204 C2. The sugar massecuite is first poured into the distributor cup acting as a charging arrangement. The distributor cup is positioned in the axis region of the centrifuge and is intended to provide as even as possible, a radial distribution of the sugar massecuite for further working in the centrifuge. In the distributor cup, the massecuite is taken along as a result of adhesion of the massecuite to the walls of the cup and is gradually accelerated up to the peripheral speed of the cup wall. During this distribution the massecuite is spread over the periphery of the distributor cup and is spun off over the top edge of the distributor can, more massecuite continues. After covering a short distance in free flight, the massecuite arrives on the inner surface of the product distributor which can also be denoted as an accelerator bell or a pre-spinning drum. During the free flight, the massecuite can be subjected to the action of steam or washwater from appropriately provided feed lines.

The known product distributors themselves are drum-like and expand downwards slightly conically. These distributors have at the lower or bottom rim a throw-off edge from which the sugar massecuite is outwardly spun off into the actual strainer basket which expands upwardly and conically and which rotates about the same vertical axis.

It has been a continous problem in the past that the massecuite fed to the distributor cup is unevenly distributed as the viscosity increases, and forms a layer of varying thickness on the inner face of the product distributor.

When, in the case of highly viscous massecuites, distributor rods are arranged standing upright in the distributor can, in order to divide up, at first mechanically, the flow of massecuite, before the massecuite reaches the inner surface of the distributor cup, strip-like inhomogeneities occur in the massecuite and continue through the product distributor as far as the strainer face of the drum.

OBJECT OF THE INVENTION

Thus, it is an object of the invention to further improve the uniformity of the distribution of the sugar massecuite in continuously operable centrifuges.

SUMMARY OF THE INVENTION

In the centrifuge according to the present invention the peripheral wall of the product distributor has several ring elements partly overlapping in the axial direction and leaving an annular gap between neighboring ring elements, and wherein the product distributor is surrounded by a downwardly conically expanding stationary bell which surrounds the distributor ring elements with a spacing all around these ring elements.

The invention markedly improves the effectiveness of the massecuite distributor of continuously operable centrifuges. The sugar massecuite which passes from the distributor cup on to the inner wall of the distributor has already been pushed downwards by the centrifugal force because of the conical expansion. Now further homogenisation is achieved by the annular gaps which are formed between each pair of ring elements. At these points the sugar massecuites are turned around or rolled over since the particles nearest to the axis on the inner wall slide away over the particles lying on the wall of the distributor because of the greater adhesion of these particles directly on the wall surface, until they reach the inner walling of whichever is the next ring downwardly reaching ring element. The thickness of the layer on the inner wall of the distributor is thus automatically made even more uniform.

It is of very special advantage if steam is fed into the region of the gap space between the distributor and the stationary bell, whereby steam enters through the annular gap or gaps into the interior of the distributor. This feature causes a particularly effective mixing of steam with the sugar massecuite. It is precisely at the transitions of the rotating cone between the ring elements that the steam reaches the interior of the distributor. In addition, the steam flows through the sugar massecuite particles spun from one ring element to the next respectively and reaches the massecuite in these gap areas just at the moment when the massecuite present an optimal surface for contact with steam or its condensate and water. Immediately afterwards, homogenizing and mixing is repeated as the massecute is exposed to a kneading movement when landing on the next ring element further downwardly located than the preceding ring element. There occurs an additional advantage in that the currents of steam passing by the ring elements on the outside thereof, namely in a further gap space between the ring elements and the stationary bell, further heat these ring elements and therefore of the cone wall. This heat is directly passed on to the massecuite flowing off on the inner wall of the ring elements of the distributor. Such heating of the ring elements; additionally improves the homogenisation and mixing.

The bell surrounding the massecuite distributor is stationary, because otherwise, the arising pressure conditions could cause a flow of air from the interior of the distributor through the annular gaps to the outside, which is undesirable.

The feed of steam is considerably more effective and uniform and also less costly than the separate heating of the distributor, such as that disclosed in GB-PS 1 074 229, for example.

Due to the rotation of the ring elements the steam in the above mentioned gap space is automatically drawn into the interior of the distributor, out of the gap space between the distributor ring elements and the bell. No special nozzles or the like are therefore necessary.

It has been found to be particularly advantageous for the numbers of ring elements to be between two and five; in particular three ring elements are efficient, whereby two annular gaps, present an economic advantage. In the case of a large number of ring elements, either the annular gap has to be relatively small, or the dimensions of the massecuite distributor with the stationary bell and thus also the whole centrifuge are greatly increased.

In a preferred embodiment, the downwardly conically expanding stationary bell projects over the massecuite distributor downwards and forms a ring with a rebound face.

This feature enables the lower face of the bell to be used for a further mixing process, since the sugar massecuite spun off by the throw-off edge of the massecuite distributor itself now lands on this rebound face, which is stationary, thus achieving, because of the tangential speed component, further smoothing-over of any accumulations of lump-shaped or sausage-shaped sugar massecuite which may still be present.

From this rebound face, the sugar massecuite can then fall downwardly into the rotating strainer basket of the centrifuge, whence they embark on the path upwards as far as the top edge, in the course of the further centrifuging.

DETAILED DESCRIPTION OF THE PREFERRED EMBODIMENTS

Figure 1:
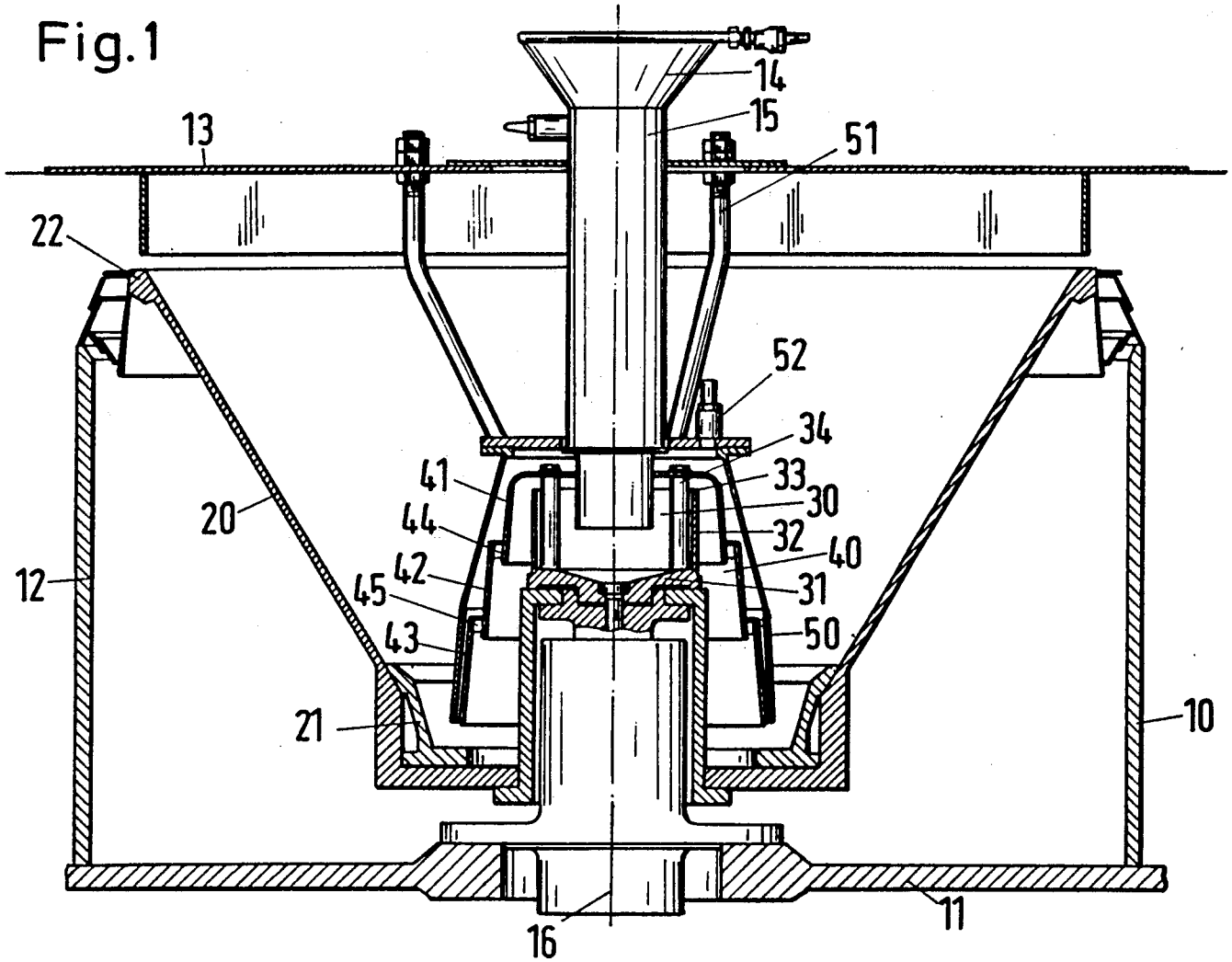
FIG. 1 is a section through a first embodiment of the invention.

The centrifuge shown has a fixed frame 10 with a floor 11, side walls 12, a covering 13 above the actual strainer basket 20, and a filling funnel 14. The sugar massecuite falls through the filling funnel 14 and a shaft 15—also stationary-into the massecuite distributor cup 30.

The strainer basket 20, the distributor cup 30 and a massecuite distributor 40 rotate about a common vertical axis 16.

The distributor cup 30 is drum-shaped with a closed floor 31 and cylindrical walls 32. The sugar massecuite arriving in the cup 30 from the shaft 15 is pushed, because more massecuite is constantly pressing downwardly, upwards over the edge 33 of the cylindrical wall 32, whence the massecuite is spun off outwards by the centrifugal force to land on the inner wall of the massecuite distributor 40. The distributor 40 and the distributor cup 30 are joined together by rods 34 which serve at the same time for mixing and homogenizing the sugar massecuite inside the distributor or distribution cup 30.

In the case illustrated, the distributor 40 has three ring elements 41, 42, 43, each of which expands conically downwards in a configuration of rotational symmetry. An annular gap 44 or 45 is provided respectively between the ring elements 41 and 42, and the ring elements 42 and 43. The fixing of the ring elements 41, 42, 43 to each other is done by individual bridges or lands not shown, but crossing the respective gaps. The topmost ring element 41 is closed towards the top, but in the region near the axis it allows to pass through the shaft 15 in order to fill the sugar massecuite into the distributor cup 30. The top ends of the rods 34 are mounted to the top closure of the ring element 41.

The ring elements 41, 42, 43 of the distributor 40 are surrounded on all sides by a downwardly conically expanding stationary bell 50, whereby a gap space is formed between the stationary bell 50 and the radially outer surfaces of the ring elements. The bell 50 is fixed to the covering 13 by a mounting device 51. The bell 50 is of rotational symmetry to the axis 16. Therefore, the gap space between the bell 50 and the ring elements of the distributor 40 is also of rotational symmetry to the axis 16.

A steam feeder 52 leads into the above mentioned gap space, whereby (not shown) can enter from outside into the region between the distributor 40 and the bell 50. This steam then passes through the annular gaps 44, 45 into the interior of the ring elements 41, 42, 43 thereby passing through the sugar massecuite present inside the rings.

Because of the centrifugal force, the sugar massecuite passes from each ring element 41, 42, 43 to the next one below which surrounds the next upper ring conically with a partial overlap on the outside. From the throw-off edge of the lowest ring element 43, the sugar massecuite is spun off to the outside where it lands on a rebound face 21 of the strainer basket 20. Thence they pass on to a strainer firmly joined to the basket floor and to this rebound face 21, and moves upwards on the strainer under the centrifugal force. A mashing arrangement can be provided in the region of the rebound face 21. The strainer basket 20 is closed towards the top by a relatively solidly constructed edge 22 from which the sugar particles are spun off to the outside and collected and further treated (not shown).

Figure 2:
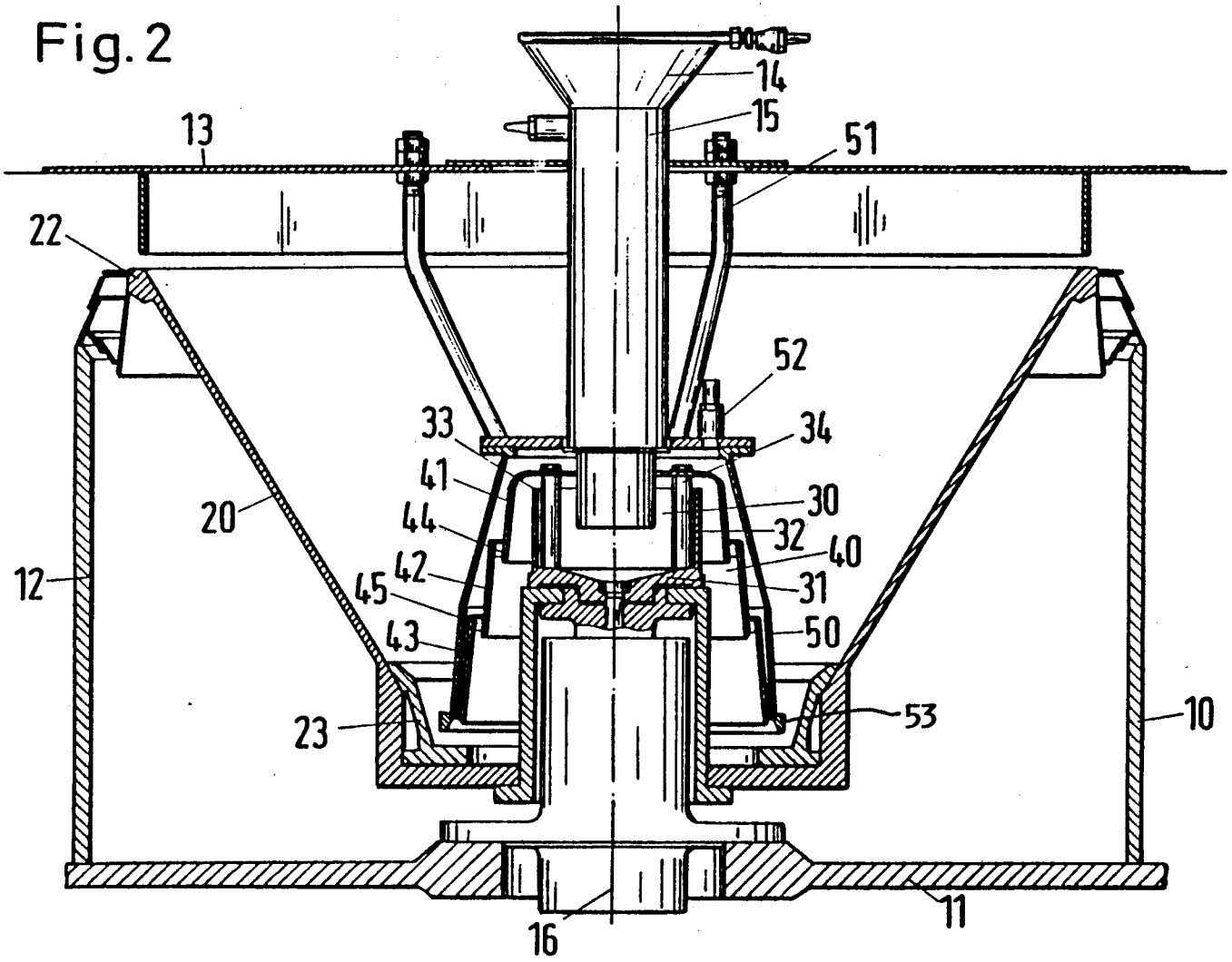
FIG. 2 is a section through a second embodiment of the invention.

The embodiment of FIG. 2 differs from the embodiment of FIG. 1 in that the stationary bell 50 extends downwards further than the lower edge of the lowest ring element 43 of the product distributor 40. The lower edge of the bell 50 is equipped with a relatively solidly constructed rim 53 which forms a rebound face. The sugar particles arriving on the throw-off edge of the lowest ring element 43 of the distributor 40 are thrown off and now jump on to the rebound face 53, not on to the rebound face 21 from FIG. 1. This leads to braking of the tangentially spun-off particles and to further mixing. The particles fall downwards from the rebound face 53 on to the basket floor 23 of the strainer basket 20, but then move, as in the embodiment of FIG. 1, along the strainer basket 20 upwards again to the edge 22. The rebound face 53 has a profile or cross-section which is the same or uniform all around the circular length of the rim 53.

The invention is not to be limited by the embodiments shown in the drawings and described in the specification which are given by way of example and not of limitation, but only in accordance with the scope of the appended claims.

What is claimed is:

1. A continuously operable centrifuge for spinning off sugar massecuite, said centrifuge comprising: an upwardly conically expanding strainer basket (20) mounted for rotation about a vertical axis (16), a downwardly conically expanding, rotatably mounted massecuite distributor (40) reaching into a floor region of said strainer basket, said massecuite distributor being positioned substantially coaxial to said strainer basket for rotating with said strainer basket, said massecuite distributor having a throw-off rim at its bottom for feeding massecuite onto said strainer basket, said massecuite distributor (40) comprising a distribution cup (30) positioned within an upper region of said massecuite distributor, said distribution cup (30) charging massecuite into an axis region of said centrifuge, said massecuite distributor (40) further comprising a plurality of rotating ring elements (41, 42, 43) partly overlapping in pairs (41, 42; 42, 43) in an axial direction and leaving at least one annular gap (44, 45) between neighboring ring elements where said ring elements partly overlap in pairs in said axial direction, said centrifuge further comprising a downwardly conically expanding stationary bell (50) surrounding said rotating ring elements of said massecuite distributor (40) with a circular gap space between said stationary bell (50) and said ring elements (41, 42, 43), whereby a roll over of massecuite in said at least one annular gap further homogenizes the massecuite.

2. The centrifuge of claim 1, further comprising steam feeder means for introducing steam into a region of said gaps and gap space, whereby steam is fed through said annular gap into the interior of said massecuite distributor.

3. The centrifuge of claim 1, wherein the number of said ring elements is from two to five.

4. The centrifuge of claim 1, wherein said downwardly expanded stationary bell (50) projects downwardly over said massecuite distributor (40), said stationary bell comprising at its lower edge a rebound rim (53).

5. The centrifuge of claim 4, wherein said rebound rim has a uniform cross-section along its entire circular length.

* * * * *